United States Patent [19]

Fayeulle et al.

[11] Patent Number: 5,057,379

[45] Date of Patent: Oct. 15, 1991

[54] HEAT ENGINE PARTS MADE OF ALLOY AND HAVING A METALLIC-CERAMIC PROTECTIVE COATING AND METHOD OF FORMING SAID COATING

[75] Inventors: Dominique M. M. Fayeulle, Charenton Le Pont; Jean-Paul Henon, Versailles; René J. Morbioli, Corbeil, all of France

[73] Assignees: Societe Nationale D'Etude et De Construction De Moteurs D'Aviation "S.N.E.C.M.A."; Association Pour La Recherche et Le Developpement Des Methodes et Processus Industriels A.R.M.I.N.E.S., both of Paris, France

[21] Appl. No.: 197,318

[22] Filed: May 23, 1988

[30] Foreign Application Priority Data

May 26, 1987 [FR] France ..... 87 07372

[51] Int. Cl.[5] ..... C03C 27/08

[52] U.S. Cl. ..... 428/632; 75/235; 75/245; 75/249; 427/34; 428/934; 428/550; 428/552; 428/566

[58] Field of Search ..... 428/550, 552, 566, 629, 428/632, 934, 633; 75/245, 249, 232, 235; 427/34

[56] References Cited

U.S. PATENT DOCUMENTS

| | | | |
|---|---|---|---|
| 3,486,927 | 12/1969 | Gauje | 427/253 |
| 4,095,003 | 6/1978 | Weatherly et al. | 427/34 |
| 4,248,940 | 2/1981 | Goward et al. | 428/623 |
| 4,328,285 | 5/1982 | Siemers et al. | 427/190 |
| 4,485,151 | 11/1984 | Stecura | 428/633 |
| 4,576,874 | 3/1986 | Spengler et al. | 428/623 |
| 4,590,090 | 5/1986 | Siemers et al. | 427/34 |

FOREIGN PATENT DOCUMENTS

| | | |
|---|---|---|
| 2571386 | 10/1985 | France . |
| 115972 | 6/1980 | Japan . |
| WO82/00162 | 1/1982 | PCT Int'l Appl. . |

*Primary Examiner*—Brooks H. Hunt
*Assistant Examiner*—Ngoclan T. Mai
*Attorney, Agent, or Firm*—Oblon, Spivak, McClelland, Maier & Neustadt

[57] ABSTRACT

A coating for a heat engine part, particularly a turbomachine part made of superalloy, comprises an electrophoretically deposited metallic structure of cellular form with uniformly disposed cells of predetermined size, the structure preferably being composed of M, Cr, Al, and Y, where M denotes Ni, Co, Fe and mixtures thereof. The cellular metallic structure is consolidated by a sintering treatment, which may be reactive, or metallization, preferably in the vapor phase, and the coating is completed by a ceramic material applied by plasma spraying.

19 Claims, 9 Drawing Sheets

HEAT ENGINE PARTS MADE OF ALLOY AND HAVING A METALLIC-CERAMIC PROTECTIVE COATING AND METHOD OF FORMING SAID COATING

BACKGROUND OF THE INVENTION

1. Field of the Invention

The present invention relates to heat engine parts made of an alloy having good mechanical strength and resistance to high temperatures, and comprising a protective coating, and relates especially to turbo-machine parts made of superalloy, particularly if nickel-based, having a protective coating for protection against corrosion and oxidation. The invention also relates to a method of forming the protective coating on such parts.

2. Summary of the prior art

The search for high performance in the development of turbo-machines, particularly for aeronautical applications, has led to ever increasing operating temperatures, while rationalization of the use of equipment makes it necessary to prolong the life of the machine parts. The result of this is the adoption of numerous solutions relating to protective coatings for providing turbo-machine parts subjected to high temperatures with protection against oxidation and/or corrosion.

U.S. Pat. No. 4,328,285 discloses the protection of superalloy gas turbine parts by a metallic undercoat having a composition of the M, Cr, Al, Y type, where M denotes Fe, Ni, Co or a mixture of these metals, applied by plasma spraying, followed by a ceramic-based coating comprising zirconium oxide and at least 15% by weight of cerium oxide, also formed by plasma spraying.

U.S. Pat. No. 4,248,940 discloses another example of a heat barrier coating for superalloy parts, the coating being formed by plasma spraying a mixture of powders comprising a bonding material of the M, Cr, Al, Y type, where M denotes Fe, Ni, Co or a mixture thereof, and a ceramic type material based on zirconium oxide stabilized by another oxide, the coating having an increasing percentage of ceramic in the direction away from the substrate.

However, no previously known solution is entirely satisfactory in relation to the particular conditions of use and taking into account the operating requirements and the improvement of the properties of thermal insulation and of resistance to combined oxidation and corrosion agents of various kinds. A particularly noticeable phenomenon has been observed which may be described as the development and the propagation of cracks or fissures under the action of stresses which develop in the coating and which are of thermal origin in particular.

Other heat engines, particularly diesel engines, also have parts which have been provided with a protective coating for the improvement of operating performance.

It is an object of the invention, therefore, to provide heat engine parts with an improved protective coating structure, and in particular a structure capable of modifying the manner of rupture observed in the coating under critical conditions of operation of the coated parts.

SUMMARY OF THE INVENTION

According to a first aspect, the invention provides a heat engine part made of an alloy having good mechanical strength and resistance to high temperatures, especially a turbo-machine part made of superalloy which is preferably nickel-based, said part having a protective coating comprising a metallic structure, preferably composed of M, Cr, Al, and Y where M is a metal selected from the group consisting of nickel, cobalt, iron, and mixtures thereof, with the possible addition of tantalum, said metallic structure being obtained by electrophoretic deposition and a consolidation treatment, said metallic structure being of a cellular form wherein the cells are substantially evenly distributed and are of a predetermined size depending on the conditions selected for said electrophoretic deposition, and said metallic structure having a modified composition and being bonded to said alloy part as a result of said consolidation treatment, and a ceramic based material applied to said metallic structure by atmospheric plasma spraying.

The consolidation treatment preferably comprises a sintering process, which may be reactive, or a metallization process, particularly a vapor phase process, at a temperature and for a period known per se for the application to said alloy.

The protective coating of the alloy part in accordance with the invention provides significant advantages in the way of improved working life and operating performance. An attempt at explaining the observed phenomenon may be begun with the tests which have been carried out.

FIGS. 1*a*, 1*b* and 1*c* show diagrammatically sectional views of a substrate 1*a* coated by a known method with a metal undercoat 1*b* and a ceramic top coat 1*c* by means of plasma spraying. From the inception of a critical crack, shown at 2 in FIG. 1*b*, as a result of the application of thermal shocks representative of the operating conditions of the coated part, FIG. 1*c* shows how a coating break appears as a result of propagation of the crack 2 upon continuation of the thermal shocks.

FIGS. 2*a*, 2*b*, 2*c* show diagrammatic views similar to those of FIGS. 1*a*, 1*b* and 1*c*, but of a substrate 2*a* coated in accordance with the invention, wherein the metallic structure 2*b* obtained by electrophoretic deposition has the required cellular form with a controlled size of cells. As a result of the applied thermal shocks a critical crack 2 is also started, as shown in FIG. 2*b*. However, the similarity stops there, since the invention provides a different fissuring mechanism. As shown in FIG. 2*c*, a deflection of the crack is observed at 3 and the crack no longer propagates in a direction parallel to the surface of the coating or to the planes of the various metal/ceramic interfaces as in the earlier coating shown in FIG. 1*c*. After that, propagation of the crack is observed to stop at 4 where it meets an element of the metallic cell structure which is more resistant to fissuring.

This attempt at an explanation, however, is only partial, and other advantages of the structure of the coating in accordance with the invention leading to an improvement of the results must be mentioned. The modification of the manner of rupture is also obtained through an improvement of the mechanical adherence at the metal/ceramic interface, the cellular structure facilitating in particular an interpenetration between the two layers. In addition, the structure obtained brings about a modification of the distribution of the stresses at the ceramic/metal interface, the result of which is, not only particular properties of crack propagation as detailed above, but also particular conditions which advantageously bring about a delay in the occurrence or inception of such fissuring or cracking. Depending on the applications of the invention, a structure of the type shown in FIGS. 2a, 2b and 2c may be desired or, in some cases, a structure of the type shown in FIG. 2d may be obtained in which the cellular metallic structure 2b is flush with the outer surface of the completed protective coating.

According to a further aspect of the invention the protective coating on a heat engine part made of an alloy having good mechanical strength and resistance to high temperatures, particularly a turbomachine part of superalloy, may be formed by a method comprising the steps of:

a) depositing on said part a metallic structure, preferably composed of M, Cr, Al, and Y, where M is a metal selected from the group consisting of Ni, Co, Fe, and mixtures thereof, with the possible addition of Ta, by electrophoretic deposition under conditions so as to obtain a structure of cellular form wherein the cells are of a predetermined size and are substantially evenly distributed;

b) subjecting said part with said deposited cellular metallic structure to a consolidation treatment, preferably consisting of a sintering process, which may be reactive, or a metallization process, particularly a vapor phase process, under conditions of temperature and time known per se for application to said alloy, so as to consolidate said structure on said part; and c) applying a ceramic-based powder to said consolidated structure on said part by atmospheric plasma spraying to complete said protective coating.

DESCRIPTION OF THE PREFERRED EMBODIMENTS

Figure 3A:
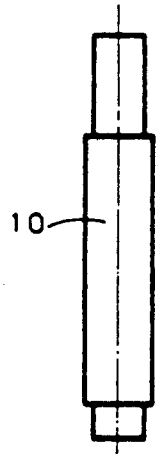
FIGS. 3a and 3b show test pieces used in carrying out protective coating performance tests on a coated superalloy part in accordance with the invention.
Figure 3B:
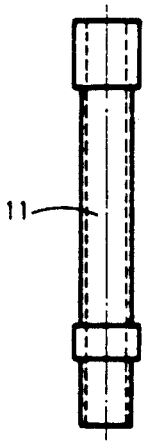

Test pieces 10 and 11 represented in FIGS. 3a and 3b were used for the production of a protective coating in accordance with the invention. In this example, the basic material of the test pieces 10 and 11 was a nickel-based superalloy of the following composition in percentages by weight:

C=0.05–0.15; Si=1 maximum; Mn=1 maximum; Cr=20.5–23.0; Fe=17.0–20.0; Mo=8.0–10.0; Co=0.50–2.50; W=0.20–1.0 and Ni the balance to 100.

After preparation by cleaning and polishing in a known manner, a test piece, such as 10 or 11, was mounted in a device, known per se, permitting the production of an electrophoretic deposition, the said test piece being mounted in the cathode position.

In this example the bath used had a base of methanol $CH_3OH$, and the electrolyte was aluminium chloride $Al_2Cl_6$. Various concentrations of electrolyte were tested, particularly at 0.5 g/litre, but was kept below 1.5 g/litre. The powder to be deposited was of type M, Cr, Al, Y as defined earlier, and in this example had the following composition in percentage by weight:

Cr=21; Al=8.47; Y=0.59; Ta=5.7; and Ni the remainder.

The powder comprised spherical particles having diameters between 45 μm and 75 μm.

Various quantities of powder between 1500 and 2000 g/l were tested, and good results were achieved using 2000 g/l.

The electric field applied was kept below a strength of 2500 $V.cm^{-1}$, and the current density at a value below 100 $mA.cm^{-2}$. The temperature of the bath was maintained at a temperature between 15° C. and 35° C., and good results were obtained at an ambient temperature between 18° C. and 21° C. In the course of the electrophoretic deposition process the different chemical reactions may be represented as follows:

the solution of the aluminium chloride in methanol produces the reactions:

a) with the residual water contained in the methanol, $$Al_2Cl_6+6H_2O \rightarrow 2[Al(OH)_3]+6HCl$$

b) with the methanol, a first ionization;

$$Al_2Cl_6+6\,CH_3OH \rightarrow 2[AlCl_2OCH_3]+4\,CH_3OH+2\,HCl$$

a second ionization:

$$Al_2Cl_6+6\,CH_3OH \rightarrow 2]\,AlCl(OCH_3)_2]+2\,CH_3OH+4\,HCl$$

and (possibly) a third ionization:

$Al_2Cl_6 + 6\ CH_3OH \rightarrow 2\ [Al(OCH_3)_3] + 6\ HCl$

Under these conditions methanol and hydrochloric acid react to give a gaseous release of methyl chloride $CH_3Cl$ (catalytic effect of $Al_2Cl_3$);

on the introduction of the M, Cr,Al, Y powder, the aluminium hydroxide and the aluminium alkoxide and chloroalkoxides are adsorbed on the surface of the M, Cr, Al, Y particles to generate a surface charge density;

after the application of the electric field, an electrophoresis and an electrolysis take place simultaneously, the voltage between the electrodes corresponding to the voltage supplied by the generator and simultaneously to the deposition of M, Cr, Al, Y powder onto the surface of the cathode constituted by the part or test piece 10 or 11 to be coated, there also being a release of hydrogen at the cathode.

Under the established conditions indicated, the deposition obtained exhibits a cellular structure brought about by the said release of hydrogen. An even distribution of the cells is obtained under the conditions indicated and the size of the cells may be adjusted, depending upon the desired structure for the particular application envisaged, by varying certain parameters of the electrophoretic deposition process, particularly the strength of the electric field or the temperature.

Figure 4:
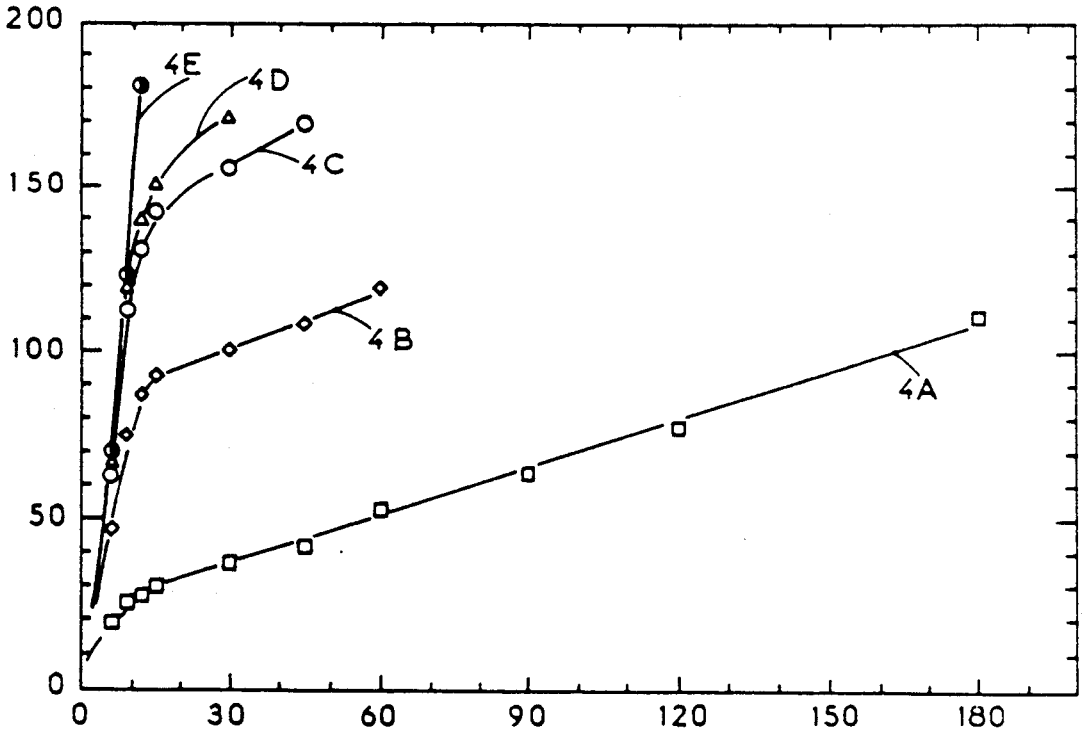
FIGS. 4, 5 and 6 are graphs showing the variation of the mass of metallic powder deposited according to different electrophoretic deposition parameters in a method in accordance with the invention.

FIG. 4 illustrates the variation of the mass of powder deposited in mg/cm$^2$, plotted as ordinates, according to the time of deposition in seconds, plotted as abscissae, with set conditions of temperature at 23° C., electrolyte concentration at 1 g/l, and initial quantity of M, Cr, Al, Y powder at 2000 g/l, and different electric field strengths as follows:

54 V.cm$^{-1}$ for curve 4A
108 V.cm$^{-1}$ for curve 4B
180 V.cm$^{-1}$ for curve 4C
360 V.cm$^{-1}$ for curve 4D
710 V.cm$^{-1}$ for curve 4E

Figure 5:
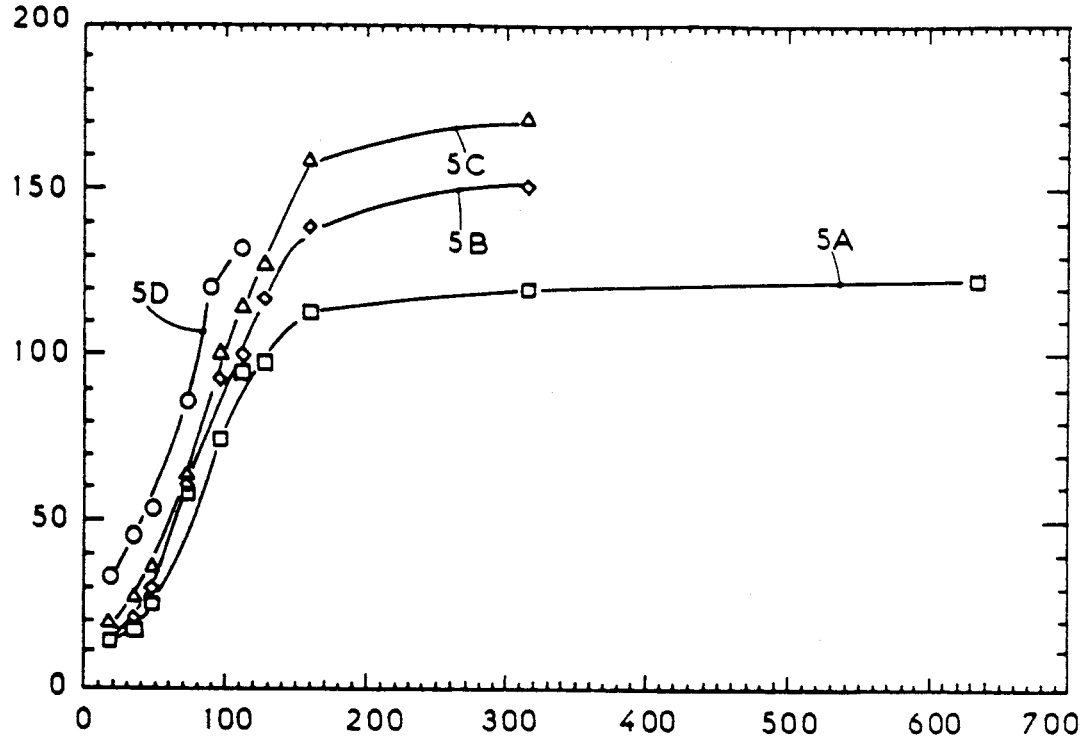

Similarly, FIG. 5 illustrates the variation of the mass of powder deposited in mg/cm$^2$, plotted as ordinates, according to the strength of the electric field applied in V.cm$^{-1}$, plotted as abscissae, with the same conditions of temperature, concentration of electrolyte, and quantity of M, Cr, Al, Y powder as in FIG. 4, and different deposition periods as follows:

9 s for curve 5A,
15 s for curve 5B,
30 s for curve 5C,
60 s for curve 5D.

Figure 6:
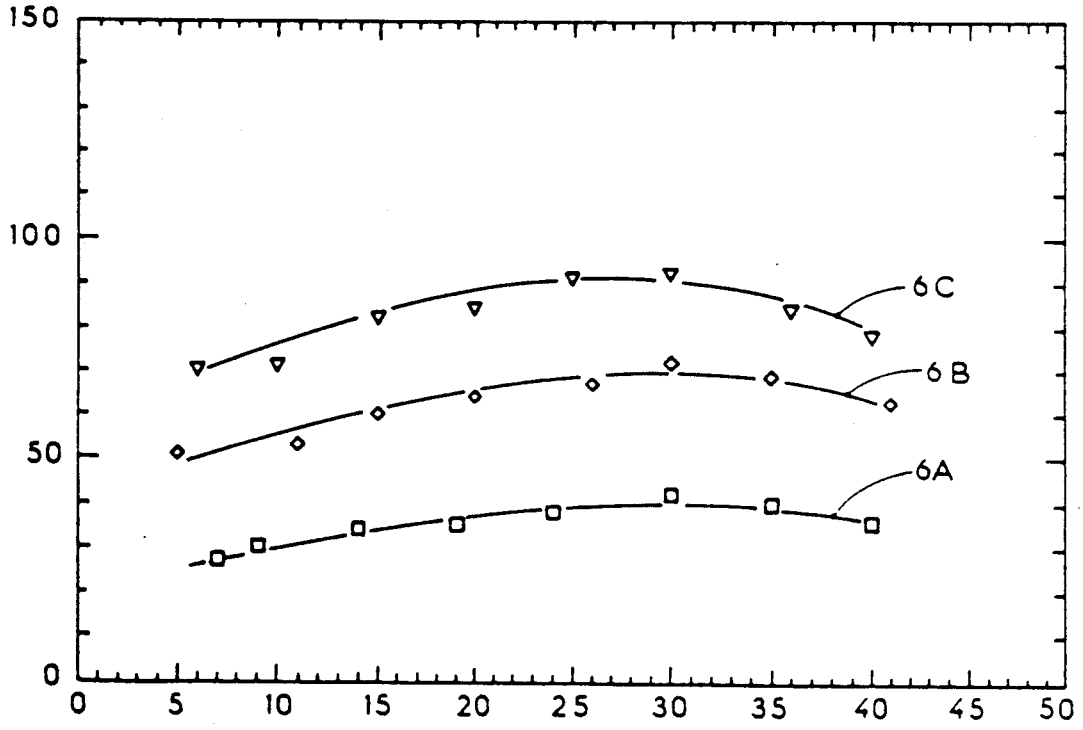

Similarly, FIG. 6 illustrates the variation of the mass of powder deposited in mg/cm$^2$, plotted as ordinates, according to the temperature of the bath in °C., plotted as abscissae, with the same conditions of electrolyte concentration and quantity of M, Cr, Al, Y powder as in FIGS. 4 and 5, a deposition period of 15 seconds, and different electric field strengths as follows:

55 V.cm$^{-1}$ for curve 6A
80 V.cm$^{-1}$ for curve 6B
110 V.cm$^{-1}$ for curve 6C

Figure 7:
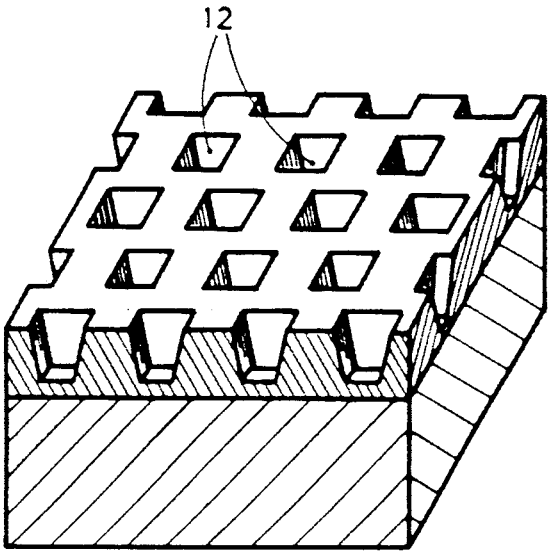
FIG. 7 is a diagrammatic view illustrating the cellular form of the metallic structure obtained by electrophoretic deposition in the method of the invention.

FIG. 7 shows a diagrammatic representation of an example of the cellular structure of the metal undercoat obtained by electrophoretic deposition under the conditions defined. As shown, an even distribution of cells 12 is obtained.

FIGS. 8*a*, 8*b*, 8*c*, 8*d* depict examples of the cellular structure obtained by varying parameters of the electrophoretic deposition, i.e. the strength of the electric field and/or the temperature, the other conditions and the deposition time (equal to 9 seconds) being fixed.

Figure 8A:
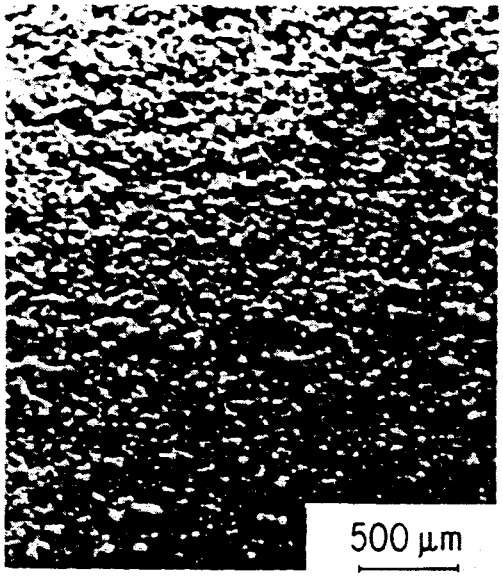
FIGS. 8a, 8b, 8c and 8d show scanning electron microscope photographs of different cellular metallic structures obtained according to the parameter values selected for the electrophoretic deposition in a method of the invention.
Figure 8B:
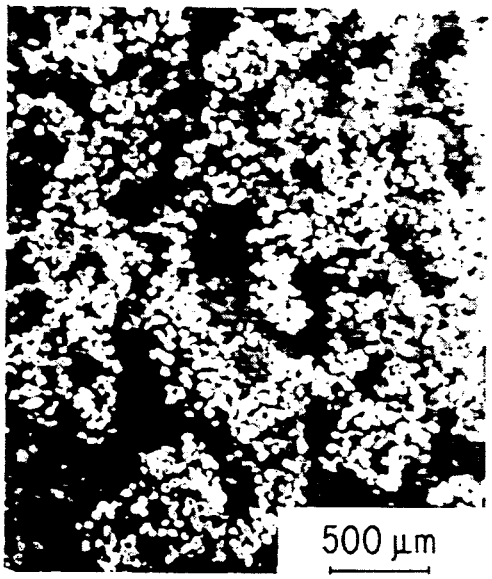

FIG. 8*a* shows a structure with small cells of size $d_c$ below 100 μm obtained at 8° C. and 100 V.cm$^{-1}$ On the other hand, FIG. 8*b* shows a structure exhibiting large cavities of size $d_c$ of the order of 500 μm and obtained at 31° C. and 130 V.cm$^{-1}$.

Figure 8C:
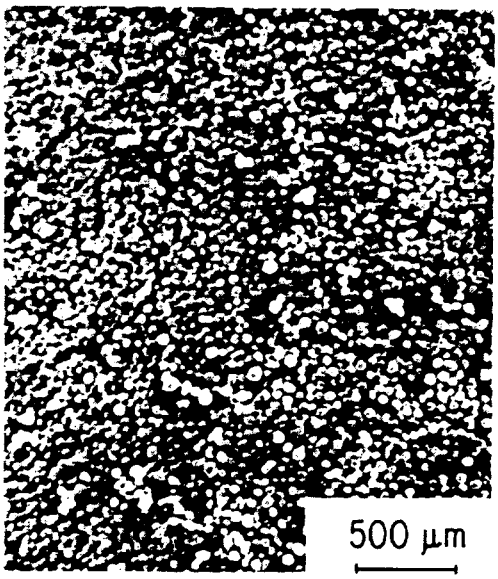
Figure 8D:
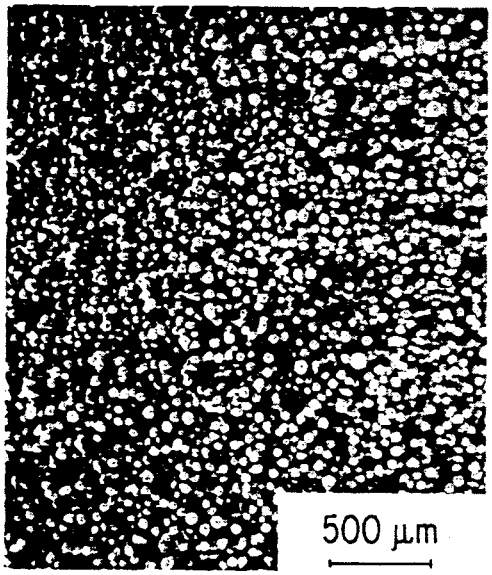

Low cell densities and variations of coating thickness may also be obtained, depending on the strength of the electric field. For example, FIG. 8*c* shows a structure with a single layer deposition of a thickness of the order of 50 μm obtained at 23° C. and 20 V.cm$^{-1}$, whereas FIG. 8*d* shows a relatively compact deposition structure of the order of 500 μm thickness obtained at 23° C. and 110 V.cm$^{-1}$.

The bath used comprising methanol with an aluminium chloride electrolyte provides additional advantages in permitting very short deposition times, thus preventing the heating up of the bath, and preventing stray depositions, the presence of aluminium hydroxychloride in particular being below 1 mg/cm$^2$. In addition, the drying of the deposition as it comes out of the electrophoretic solution is immediate as a consequence of the low vapor pressure of methanol.

The need for adequate mechanical strength, amongst other things, of the electrophoretically deposited M, Cr, Al, Y structure, leads to the provision of the consolidation treatment for the cellular metallic structure coating the superalloy part. This treatment also aims at ensuring satisfactory chemical protection properties for the coating. One method of carrying out this treatment comprises performing a thermo-chemical aluminizing treatment in the vapor phase. The temperature conditions and the duration of this treatment suitable for the superalloy constituting the basic substrate of the part to be coated are well established, and have been described in particular in U.S. Pat. No. 3,486,927. It will not therefore be necessary to expand on other details of the treatment which are standard knowledge.

Figure 9A:
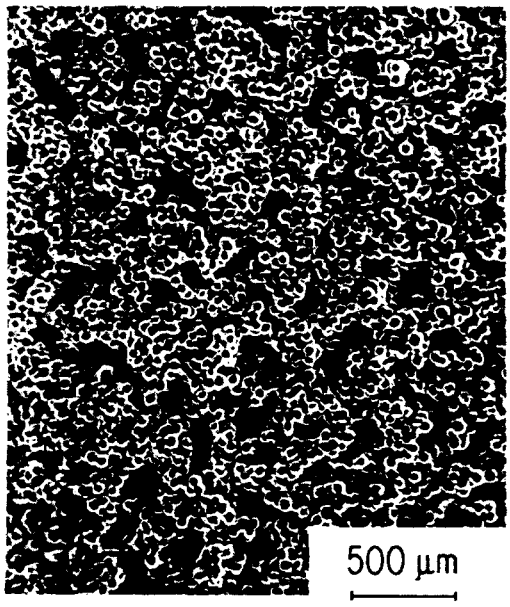
FIGS. 9a and 9b show scanning electron microscope photographs of two cellular metallic structures after consolidation treatment of the electrophoretic deposition.
Figure 9B:
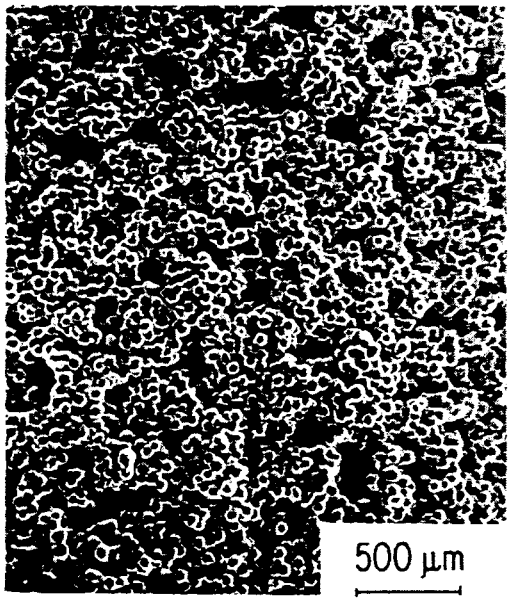
Figure 9D:
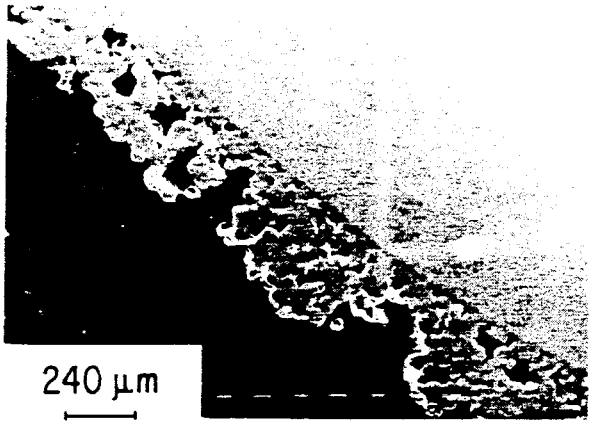
FIGS. 9c and 9d are scanning electron microscope photographs showing details of the bond between the deposited coating and the substrate.
Figure 9C:
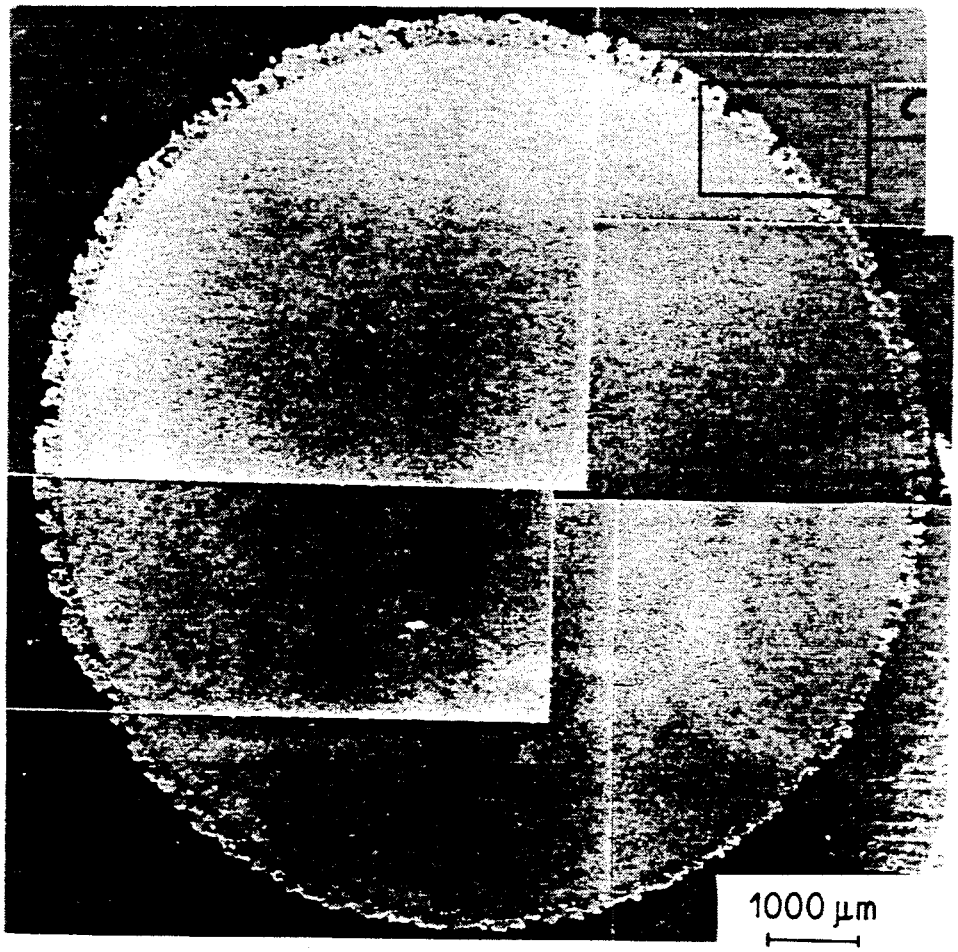

FIGS. 9*a* and 9*b* show scanning electron microscope photographs of two test pieces having undergone this aluminizing treatment in the vapor phase. For the test piece of FIG. 9*a* the duration was 1 hour at 1155° C. The initial structure is preserved and the sectional view of the test piece shown in FIG. 9*c*, as well as the detail of the bond between the substrate and the deposit shown in FIG. 9*d*, shows the absence of detachment and the good bonding with the substrate. In the test piece of FIG. 9*b* the duration of the process was 3 hours at 1150° C. A good consolidation is also obtained, but the deposit is slightly less porous.

The protective coating is completed by the application of a ceramic material forming a thermal barrier. The constituent chosen is zirconium oxide $ZrO_2$ having its phase stability ensured by another mixed oxide. In the example produced, the powder used comprised 8% $Y_2O_3$ by weight mixed with $ZrO_2$, and had a grain size between 45 and 75 μm. An atmospheric type plasma spraying under operating conditions usual for this type of application was carried out to apply the ceramic powder material.

Figure 7A:
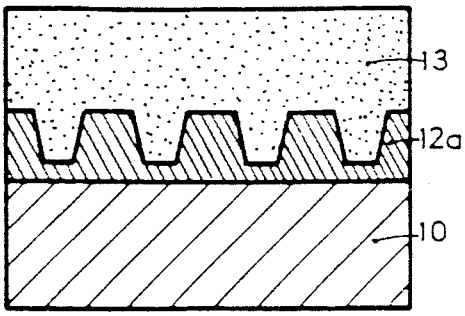
FIGS. 7a and 7b are sectional diagrams illustrating the structure of the final coating obtained in two embodiments of the invention.

After spraying the ceramic, the initial cellular form of the consolidated metallic structure was retained. FIG. 7*a* shows a diagrammatic representation of a fully coated part, showing at 10 the superalloy substrate, at 12*a* the metallic structure of cellular form, and at 13 the ceramic material. Depending on the intended usage of the part, a coating structure of the type shown in FIG.

Figure 7B:
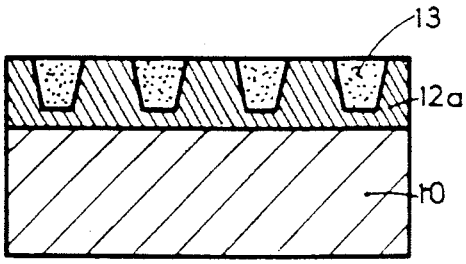
Figure 10A:
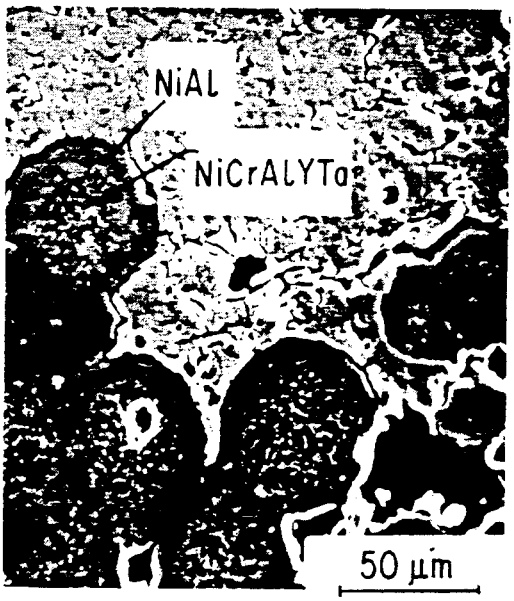
FIG. 10a shows a detail of FIG. 10 to a larger scale.
Figure 10:
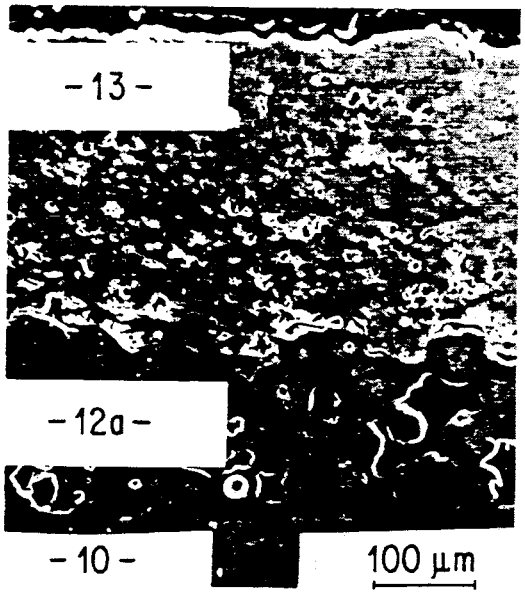
FIG. 10 shows a scanning electron microscope photograph of a final coating structure in accordance with the invention.

7a may be desired. Alternatively, a structure as shown in FIG. 7b may be obtained, in which parts of the cellular metallic structure 12a are flush with the surface of the coating obtained after application of the ceramic material 13. FIG. 10 shows a scanning electron microscope photograph of an example of a coated part in accordance with the invention showing the filling of the cells of the metallic structure with the ceramic material, and FIG. 10a shows a magnified detail.

Various tests of plasma spraying of the ceramic concerned were carried out successfully with varying morphology of the cell structure of the metallic undercoat used, e.g. structures with a cell size $d_c$ which is either below 100 μm between 100 and 300 μm, or greater than 300 μm.

Figure 11:
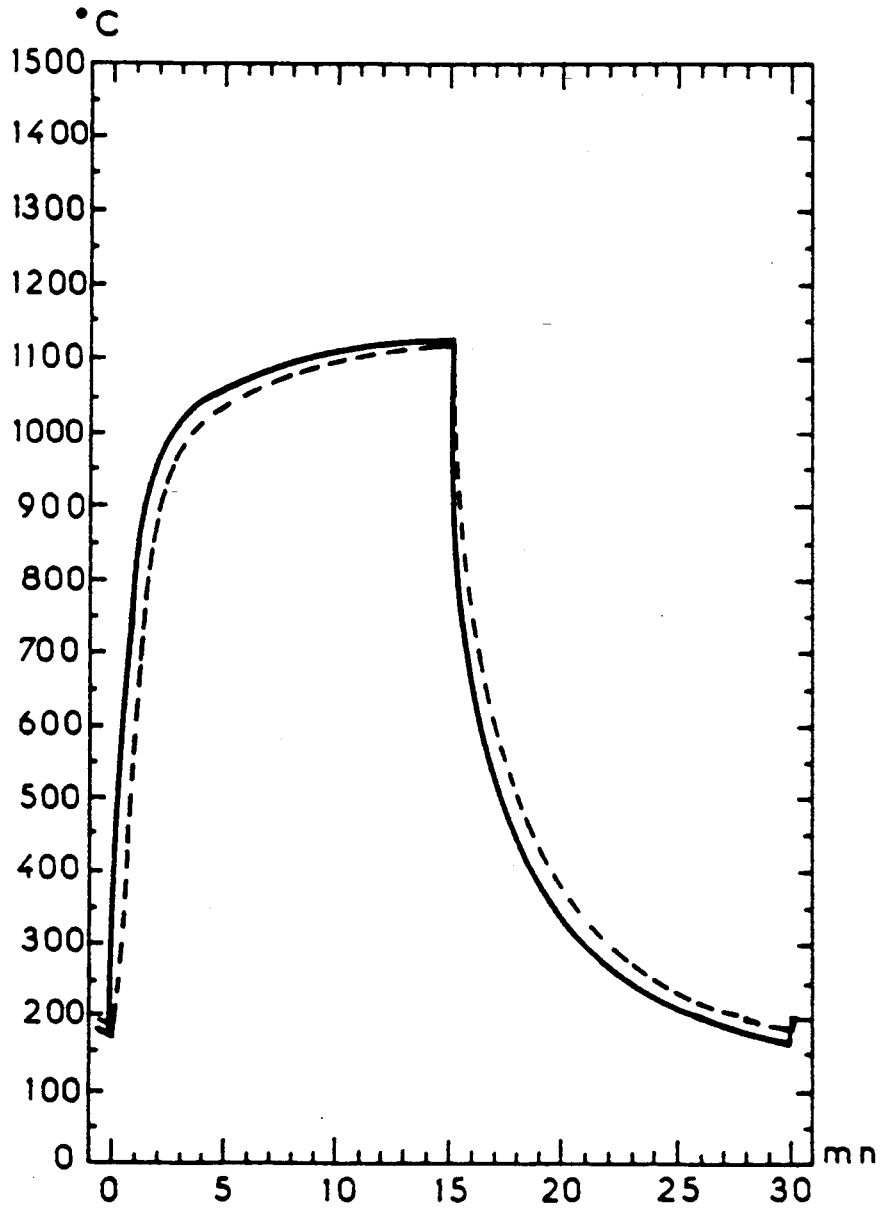
FIG. 11 is a diagram plotting a heat cycle applied to a test piece coated in accordance with the invention; and, FIG. 12 shows diagrammatically the results of thermal shock behaviour tests carried out on various test pieces following the cycle of FIG. 11.

Tests were also carried out to test the stability of coated superalloy parts in accordance with the invention under conditions representative of the conditions likely to be experienced by the coated parts during use. A particular and significant test relates to thermal shock resistance. It consisted of subjecting the test pieces coated in accordance with the invention to thermal cycles corresponding to the cycle represented in FIG. 11 and decaying in 15 minutes to 110° C. followed by a cooling down in ambient air for 15 minutes.

Figure 12:
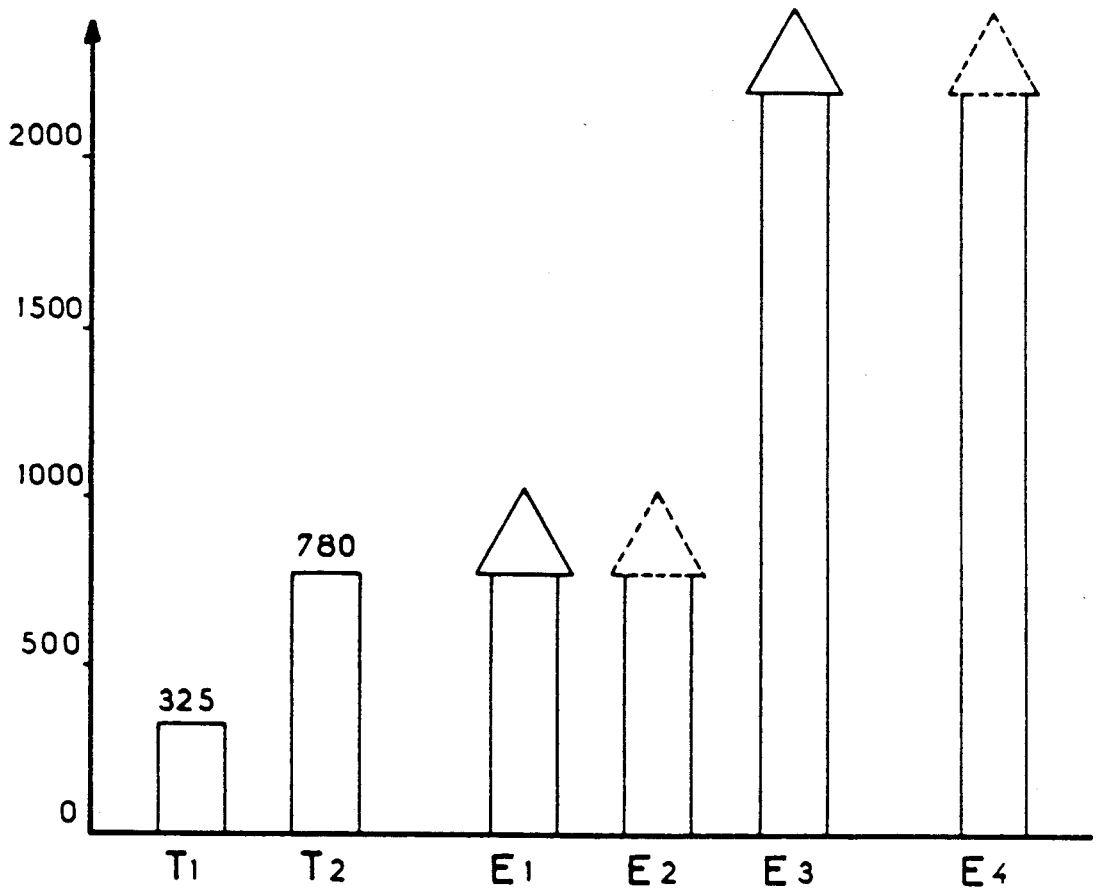

FIG. 12 shows in diagrammatic form the results obtained on six test pieces. Two reference test pieces T1 and T2 were coated solely by plasma spraying with a metal undercoat of M, Cr, Al, Y composition and with an outer ceramic coating, while four test pieces $E_1$, $E_2$, $E_3$, $E_4$ were given a coating in accordance with the invention. The length of life of each test piece is represented in FIG. 12 by the number of cycles indicated as ordinates corresponding to each test piece. With the reference test pieces $T_1$ and $T_2$, fissuring and detachment of the ceramic coating were observed after the number of cycles indicated. Test piece $E_1$, at a duration equal to that of $T_2$, exhibited low fissuring but no detachment. Test pieces $E_2$ and $E_3$ have a longer life than $T_2$, and after 2083 cycles (instead of 780 cycles for $T_2$) $E_3$ showed fissuring but no detachment. $E_4$ was subjected to a more severe thermal cycling comprising 8 minutes at 1100° C. and 2 minutes forced cooling in compressed air, but nevertheless its life was greater than 2000 cycles.

Figure 1A:
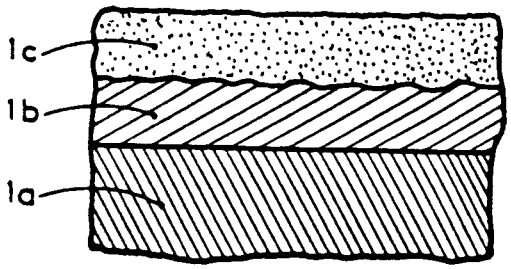
FIGS. 1a, 1b and 1c are diagrammatic sectional views of a part with a known form of protective coating, and have been described earlier.
Figure 1B:
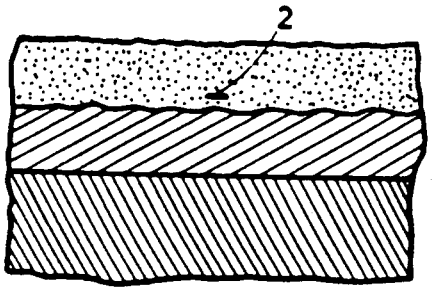
Figure 1C:
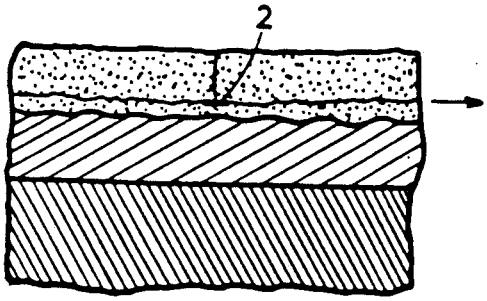
Figure 2A:
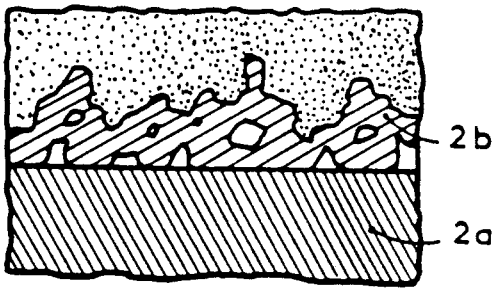
FIGS. 2a, 2b and 2c are similar sectional views of a part with a coating in accordance with the invention
Figure 2B:
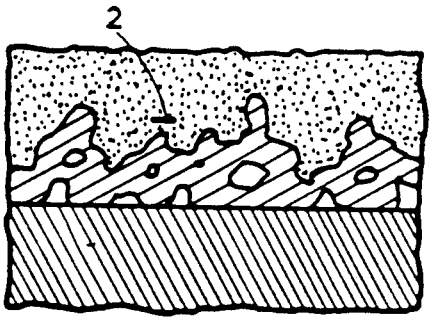
Figure 2C:
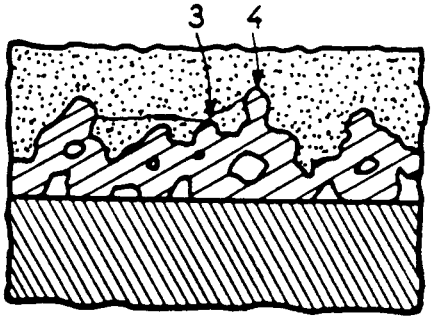
Figure 2D:
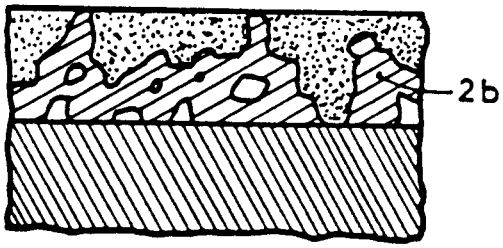
FIG. 2d is a sectional view of a part with an alternative form of coating in accordance with the invention.

From these results and the micrographic observations carried out it has been shown that the intended aims of the invention have been attained, particularly the modification of the distribution of the stresses, especially of thermal origin, at the interface between the cellular metallic structure and the outer ceramic coating. As noted earlier with reference to FIGS. 2a, 2b and 2c, the propagation of cracks is opposed or blocked by the presence of cells in the metal undercoat, but it seems also that a lower level of stresses is obtained at the metal/ceramic interface as a result of improved ductility of the metallic structure due to its cellular form. As a result of the cellular structure there is, in particular, an improved accommodation of thermal expansion, and rupture inception points may occur at the metal/ceramic interface in a very dispersed manner, permitting distribution of the stresses at a lower level at each point. Indeed, the level of stresses resulting from differential metal/ceramic expansion is no longer determined by the dimensions of the coated parts but by the size and the distribution of the cells formed in the coating.

Other advantages have been noted resulting from the particular structure of the protective coating in accordance with the invention. In particular, the heat insulation provided by the coating is increased as a result of the presence of the cells in the metallic structure which are filled with ceramic material. Moreover, the thermochemical aluminizing treatment in the vapor phase applied in the described embodiments of the invention, in addition to the consolidation of the cellular metallic structure also ensures excellent chemical protection from the said treatment.

Other test examples have also been made using flat plates of 30×30×5 mm of superalloy and have led to the same good results, which shows that superalloy parts of various shapes can be coated in accordance with the invention.

We claim:

1. A heat engine part made of an alloy having good mechanical strength and resistance to high temperatures, said part having a protective coating comprising a metallic structure obtained by electrophoretic deposition and a consolidation treatment, said metallic structure being of a cellular form wherein the cells are substantially evenly distributed and are of a predetermined size depending on the conditions selected for said electrophoretic deposition, and said metallic structure having a modified composition and being bonded to said alloy part as a result of said consolidation treatment, and a ceramic based material applied to said metallic structure by atmospheric plasma spraying.

2. A heat engine part according to claim 1, wherein said metallic structure is composed of M, Cr, Al, and Y, where M is a metal selected from the group consisting of nickel, cobalt, iron, and mixtures thereof.

3. A turbo machine part made of superalloy having good mechanical strength and resistance to high temperatures, said part having a protective coating for providing protection against corrosion and oxidation, said protective coating comprising a metallic structure obtained by electrophoretic deposition and a consolidation treatment, said metallic structure being of a cellular form wherein the cells are substantially evenly distributed and are of a predetermined size depending on the conditions selected for said electrophoretic deposition, and said metallic structure having a modified composition and being bonded to said superalloy part as a result of said consolidation treatment, and a ceramic based material applied to said metallic structure by atmospheric plasma spraying.

4. A turbo machine part according to claim 3, wherein said superalloy is nickel based.

5. A turbo machine part according to claim 3, wherein said metallic structure is composed of M, Cr, Al and Y, where M is a metal selected from the group consisting of nickel, cobalt, iron, and mixtures thereof.

6. A turbo machine part according to claim 3, wherein said ceramic based material in said protective coating consists of zirconium oxide $ZrO_2$ stabilised by 8% $Y_2O_3$ by weight, and is obtained from a powder having a grain size between 45 μm and 75 μm.

7. A turbo machine part according to claim 4, wherein said metallic structure is formed from a powder of the following composition by weight, 21% Cr, 8.47% Al, 0.59% Y, 5.7% Ta, and Ni as the remainder, said powder having a particle diameter of between 45 μm and 75 μm and being electrophoretically deposited to form said cellular metallic structure in a methanol ($CH_3OH$) bath containing aluminum chloride ($Al_2Cl_6$) as an electrolyte at a concentration not exceeding 1.5 g/l and said powder in an amount between 1500 and 2000 g/l, said electrophoretic deposition being carried out with an applied electric field below 2500 $V.cm^{-1}$, a current density below 100 $mA.cm^{-2}$, a bath temperature of between 15° C. and 35° C., and a deposition time of from 1 second to 3 minutes depending on the thickness of said structure required and the strength of said applied electric field, and said deposited cellular metallic structure being consolidated by a vapor phase aluminizing treatment carried out at about 1150° C. for a period of from 1 to 3 hours.

8. A heat engine part according to claim 1, wherein said metallic structure is subjected to consolidation treatment by sintering.

9. A heat engine part according to claim 8, wherein said sintered metallic structure is obtained by reactive sintering.

10. A heat engine part according to claim 1, wherein said metallic structure is subjected to consolidation treatment by metallization in the vapor phase.

11. A method of forming a protective coating on a heat engine part made of an alloy having good mechanical strength and resistance to high temperatures, comprising the steps of:

(a) depositing a metallic structure on said heat engine part by electrophoretic deposition under conditions which produce a metallic structure of cellular form wherein the cells are of a required size and are substantially evenly distributed;

(b) subjecting said part with said deposited cellular metallic structure to a consolidation treatment to consolidate said structure on said part; and (c) applying a ceramic based powder to said consolidated structure on said part by atmospheric plasma spraying to complete said protective coating.

12. A method according to claim 11, wherein said part is a turbo machine part made of superalloy, and said protective coating provides protection against corrosion and oxidation.

13. A method according to claim 12, wherein said superalloy is nickel based.

14. A method according to claim 11, wherein said metallic structure deposited on said part in step (a) is composed of M, Cr, Al, and Y, wherein M is a metal selected from the group consisting of nickel, cobalt, iron, and mixtures thereof.

15. A method according to claim 11, wherein said consolidation treatment in step (b) consists of a sintering process.

16. A method according to claim 15, wherein said sintering process is reactive.

17. A method according to claim 11, wherein said consolidation treatment of step (b) consists of a metallization process.

18. A method according to claim 17, wherein said metallization process is a vapor phase process.

19. A method according to claim 13, wherein said electrophoretic deposition step (a) comprises providing an electrophoresis bath containing methanol ($CH_3OH$), aluminium chloride ($Al_2Cl_6$) as an electrolyte at a concentration not exceeding 1.5 g/l, and a powder of the following composition by weight: 21% Cr, 8.47% Al, 0.59% Y, 5.7% Ta, and Ni as the remainder, said powder being present in an amount between 1500 and 2000 g/l, bringing said bath to a temperature between 15° C. and 35° C., placing said part to be coated in said bath, and carrying out electrophoresis with an applied electric field below 2500 $V.cm^{-1}$ and a current density below 100 $mA.cm^{-2}$ to deposit said powder on said part to produce said cellular metallic structure, said deposition being carried out for a period of from 1 second to 3 minutes depending on the thickness of said structure required and the value of said applied electric field.

* * * * *

UNITED STATES PATENT AND TRADEMARK OFFICE

CERTIFICATE OF CORRECTION

PATENT NO. : 5,057,379

DATED : October 15, 1991

INVENTOR(S) : DOMINIQUE ET AL

It is certified that error appears in the above-identified patent and that said Letters Patent is hereby corrected as shown below:

| COL. | LINE | |
|---|---|---|
| 7, | 24, | delete "110°" and insert --1100°--; |

Signed and Sealed this

First Day of June, 1993

*Attest:*

Michael K. Kirk

MICHAEL K. KIRK

*Attesting Officer*

*Acting Commissioner of Patents and Trademarks*